US005850242A

United States Patent [19]

Asaba

[11] Patent Number: 5,850,242

[45] Date of Patent: Dec. 15, 1998

[54] RECORDING HEAD AND RECORDING APPARATUS AND METHOD OF MANUFACTURING SAME

[75] Inventor: Tetsuo Asaba, Odawara, Japan

[73] Assignee: Canon Kabushiki Kaisha, Tokyo, Japan

[21] Appl. No.: 612,438

[22] Filed: Mar. 7, 1996

[30] Foreign Application Priority Data

Mar. 7, 1995 [JP] Japan ..... 7-047626

[51] Int. Cl.[6] ..... B41J 2/05

[52] U.S. Cl. ..... 347/59; 257/378; 438/202; 438/376; 347/209

[58] Field of Search ..... 347/59, 58, 57, 347/209, 210, 211; 257/378, 370; 437/51, 59; 438/202, 376

[56] References Cited

U.S. PATENT DOCUMENTS

| | | | |
|---|---|---|---|
| 3,264,493 | 8/1966 | Price . | |
| 3,401,319 | 9/1968 | Watkins | 257/378 X |
| 3,663,869 | 5/1972 | Strull | 257/378 |
| 4,217,688 | 8/1980 | Ipri | 257/378 |
| 4,429,321 | 1/1984 | Matsumoto | 347/59 |
| 4,479,134 | 10/1984 | Kawanabe | 347/59 X |
| 4,859,878 | 8/1989 | Murayama | 257/370 X |
| 5,028,977 | 7/1991 | Kenneth | 257/370 |
| 5,247,200 | 9/1993 | Momose | 257/378 |
| 5,322,811 | 6/1994 | Komuro | 437/51 |
| 5,602,576 | 2/1997 | Murooka | 347/59 |

FOREIGN PATENT DOCUMENTS

| | | | |
|---|---|---|---|
| 0532877 | 3/1993 | European Pat. Off. | B41J 2/16 |
| 404041258 | 2/1992 | Japan | B41J 2/345 |
| 5-185594 | 7/1993 | Japan | B41J 2/05 |

*Primary Examiner*—Joseph Hartary
*Attorney, Agent, or Firm*—Fitzpatrick, Cella, Harper & Scinto

[57] ABSTRACT

The occupied area of a heater drive circuit of a recording head is reduced, and the number of manufacturing steps is decreased. As a circuitry of the heater drive unit, the final stage of the drive unit is constituted of a pnp or npn bipolar transistor, the heater, which is a load, is connected to the emitter side, and the collectors of each transistor are connected commonly to the base itself and grounded. The prestage of the drive unit is formed of the prestage of a MOS type element whose polarities are reversed to those of the final stage, i.e., an n-type MOS transistor with respect to the final stage of a pnp bipolar transistor and a p-type MOS transistor with respect to the final stage of a npn bipolar transistor, and the source of the prestage is grounded.

33 Claims, 10 Drawing Sheets

RECORDING HEAD AND RECORDING APPARATUS AND METHOD OF MANUFACTURING SAME

BACKGROUND OF THE INVENTION

1. Field of the Invention

The present invention relates to a recording apparatus for recording characters and images on a recording medium, such as paper, plastic film or textiles. More particularly, the present invention relates to a recording head and a recording apparatus for performing recording by using generated heat, and a method of manufacturing the recording head and the recording apparatus.

2. Description of the Related Art

As an apparatus for performing recording by using heat, a thermal transfer printer, a thermal printer, and the like are known. The recording apparatus which receives the most attention is the ink jet printer which ejects ink using heat.

In order to make the recording head smaller and simplify the drive circuitry, attempts have been made to form a heat generating member (heater) and a drive circuit as one unit.

The basic construction of a recording head having a heater and a drive circuit formed integrally is disclosed in U.S. Pat. No. 4,429,321. Improved constructions thereof are disclosed in Japanese Patent Laid-Open No. 5-185594, European Patent No. 0532877, and U.S. Pat. No. 922,870 (filed on Jul. 31, 1992).

The circuitry which was first conceived by the inventors of the present invention on the basis of such prior art is shown in FIG. 16. In FIG. 16, npn transistors Tr1 and Tr2 are Darlington-connected, and the collector which is one of the main electrode regions is connected to a heat generating member $R_H$.

FIG. 17 shows the cross-section of the npn transistor Tr2 of FIG. 16. Reference numeral 301 denotes a p-type silicon substrate. Reference numeral 302 denotes an n-type silicon epitaxial layer. Reference numeral 303 denotes an n-type buried layer. Reference numeral 304 denotes a p-type buried layer. Reference numeral 305 denotes a deep p-type diffusion layer. Reference numeral 306 denotes a deep n-type diffusion layer. Reference numeral 307 denotes a p-type diffusion layer which forms a base. Reference numeral 308 denotes an n-type diffusion layer which forms an emitter. Reference numeral 309 denotes a field oxide film of $SiO_2$ or the like. Reference numeral 310 denotes an insulating film of CVD (Chemical Vapor Deposition) $SiO_2$ or the like.

In the construction shown in FIG. 17, it is necessary to take up the occupied area of an isolation area shown as region I as a large area. In contrast to this, the arrangement pitch of the heat generating members Rh must be small. The reason for this is that the arrangement pitch of the heat generating members corresponds to the arrangement pitch of the ink orifices, and therefore to increase the recording density the arrangement pitch of the heat generating members must be made as small as possible. Therefore, unless the occupied area of the drive circuit is made small, the recording head cannot be made small.

In the construction shown in FIG. 17, since an epitaxial layer is required, the number of manufacturing steps is increased, and the manufacturing time is increased. Further, if a CMOS [Complementary MOS (Metal Oxide Semiconductor)] circuit is built in the same substrate, the number of manufacturing steps increases by an amount corresponding to the CMOS circuit. When viewed from another perspective, in addition to the CMOS manufacturing step, the step for manufacturing a bipolar transistor, shown in FIG. 17, increases.

In particular, in a drive circuit for use in a recording head for the purpose of generating thermal energy, the approach in which each transistor is made small and the chip size also is made small, as in a conventional logic IC, is not sufficient. The reason for this is that a large electric current is necessary to generate sufficient heat to boil ink and, for this purpose, a transistor having a sufficiently large PN junction area and a large isolation area is required.

Therefore, as described above, making the isolation area small and reducing the number of manufacturing steps are effective means for constructing a recording head having a heat generating member.

SUMMARY OF THE INVENTION

It is an object of the present invention to solve the above-described problems and to provide a small recording head.

It is another object of the present invention to provide a recording head which can be manufactured in a small number of manufacturing steps.

It is a further object of the present invention to provide an inexpensive recording head and an inexpensive recording apparatus.

To achieve the above-described objects, according to one aspect of the present invention, there is provided a recording head, as well as a recording apparatus, comprising: a heat generating member having at least two terminals and a drive circuit for supplying electric current to the heat generating member, wherein the drive circuit includes a bipolar transistor having a plurality of main electrode regions and a control electrode region, one of the main electrode regions being connected to one of the terminals of the heat generating member, and a field-effect transistor having a plurality of main electrode regions and having one of the main electrode regions connected to the control electrode region of the bipolar transistor, and wherein a first voltage source is connected to the other terminal of the heat generating member, a second voltage source is connected to the other main electrode region of the bipolar transistor, a third voltage source is connected to the other main electrode region of the field-effect transistor, and the conducting type of the main electrode region of the bipolar transistor and the conducting type of the main electrode region of the field-effect transistor are opposite to each other. Methods of making the same are also proposed.

According to another aspect of the present invention, there is provided an ink jet recording head and a recording apparatus for driving a heater array having a plurality of heaters for heating ink in order to generate gas bubbles and thereby ejecting ink, wherein the drive circuit is formed in the same substrate as the heater array, and constitutes a plurality of circuits having drive units each formed by a field-effect transistor having a drain, at the prestage and a bipolar transistor having an emitter, collector and base, at the final stage, one terminal of one heater being connected to each emitter of the plurality of bipolar transistors, and a logic part in the same substrate as the heaters and drive units, and in the drive units the respective collectors of the plurality of bipolar transistors being commonly connected and grounded, the respective bases of the plurality of bipolar transistors being connected to the respective drains of the field-effect transistor, and the other terminal of the plurality of heaters being connected to a terminal for applying a voltage to the heater. Methods of making the same are also proposed.

The above and further objects, aspects and novel features of the invention will become more apparent from the following detailed description when read in connection with the accompanying drawings.

DETAILED DESCRIPTION OF THE PREFERRED EMBODIMENTS

Figure 1:
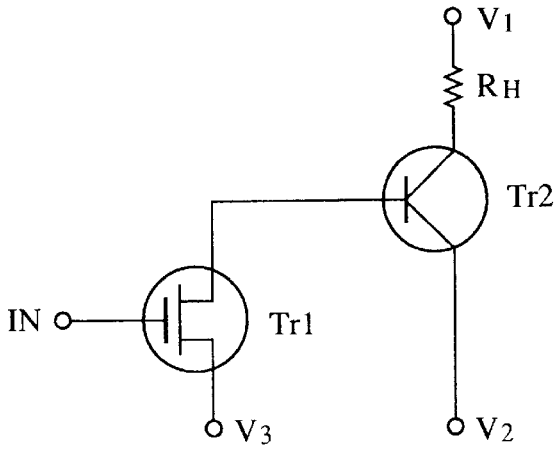
FIG. 1 is a circuit diagram illustrating a feature of the present invention.

FIG. 1 shows the circuitry of a recording head in accordance with a preferred embodiment of the present invention.

Reference character $R_H$ denotes a heat generating member (heater). Reference character Tr1 denotes a field-effect transistor (FET). Reference character Tr2 denotes a bipolar junction transistor (BJT).

One terminal of the heater $R_H$ is connected to a first voltage source V1; one of the main electrode regions of the transistor Tr2 is connected to a second voltage source V2; and one of the main electrode regions of the transistor Tr1 is connected to a third voltage source V3. A drive control signal is fed to terminal IN.

The main electrode region refers to the collector or emitter of the bipolar transistor, or the source or the drain of the field-effect transistor. The control electrode region refers to the base or the gate of the transistor.

Here, the conducting type of the transistor is determined. When the transistor Tr1 is made to be an N-channel type, the transistor Tr2 is set to be a pnp type. When, in contrast, the transistor Tr1 is made to be a P-channel type, the transistor Tr2 is set to be an npn type. For this purpose, the conducting types of the main electrode regions of the two transistors Tr1 and Tr2 are set oppositely. In this way, the circuit shown in FIG. 1 can be made using a fewer number of steps by using a common semiconductor region.

As a semiconductor, Ge, GaAs, InP, or SiX may be used. However, inexpensive Si may be preferable. Examples of a heat generating member $R_H$ include a diffusion resistor and a thin film resistor. Since it is preferable that silicon oxide be present in the base as a heat storage layer, the thin film resistor is more desirable.

As a thin film resistor, a material which, when electric current is made to flow therethrough, generates heat in an amount sufficient to heat ink is desirable. In particular, in order to eject ink repeatedly by causing at least one bubble to be generated in the liquid ink and due to the expansion and contraction of the bubble, it is necessary to use a heat generating member capable of rapidly heating ink up to a temperature exceeding the nucleate boiling temperature. Therefore, preferable materials for forming the thin film resistor are an alloy or compound containing at least one of Ti, Al, W, Cu, Ta, Mo, Cr, or Hf. TiN and HfB are preferable.

The heater $R_H$ may be manufactured on the same substrate as the transistors Tr1 and Tr2.

Of the reference voltages supplied from each of the voltage sources V1, V2, and V3, the voltages of the second and third voltage sources can be set at the same potential. Each reference voltage value may be appropriately determined according to the conducting type of the transistors Tr1 and Tr2. Although a Darlington-connected transistor may be provided between the transistors Tr1 and Tr2, they should preferably be directly connected as shown in FIG. 1.

Further, in the present invention, a CMOS circuit for supplying a signal for drivingly controlling the transistor Tr1 at a desired timing may be provided integrally. Although the transistors Tr1 and Tr2 may be formed within a common active region without a device isolation region being provided in between, the two transistors may preferably be formed independently of each other in separate active regions isolated by a field insulating film.

The occupied area of one bipolar transistor Tr2 for use in the present invention should preferably be larger than the occupied area of another field-effect transistor in order to drive the heater properly.

More preferably, when the occupied area of one bipolar transistor is twice as large as the occupied area of one field-effect transistor, or more preferably, at least ten times as large, both the driving performance and the chip size (substrate size) will reach desirable values.

The bipolar transistor Tr2 may be formed longer to be along its length, and the transistor Tr1 may be disposed along the length of the bipolar transistor Tr2.

In addition, it is preferable that at least one of the main electrode regions of the field-effect transistor be formed of a region having a high concentration of impurities and a region having a low concentration of impurities so as to increase the dielectric breakdown voltage.

Figure 2:
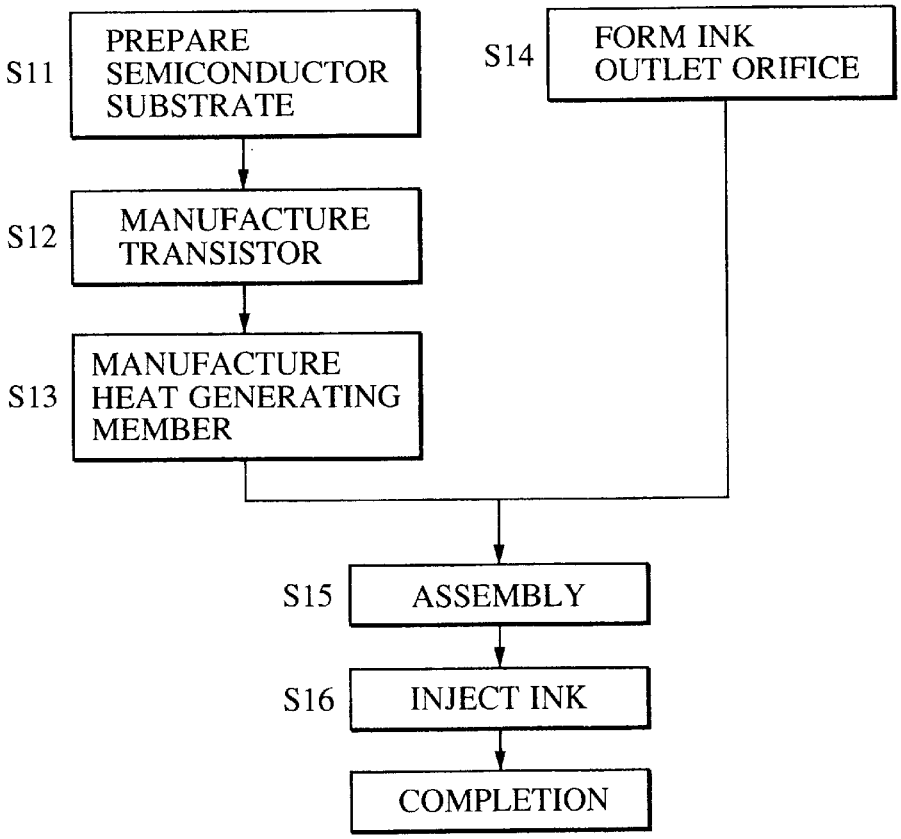
FIG. 2 is a flowchart showing the steps for manufacturing a recording head according to the present invention.

FIG. 2 is a flowchart showing the steps of manufacturing a recording head in accordance with a preferred embodiment of the present invention.

In step S11, a semiconductor substrate is prepared. In step S12, a transistor is made. The method of making a transistor comprises a step of forming a field insulating film and forming an active region, a step of diffusing a base, a step of diffusing the source and the drain, a step of diffusing an emitter, and a step of making a gate insulating film and a gate electrode.

In step S13, the heat generating member is made. Step S13 and step S12 may be performed in any order or at the same time.

In step S14, an ink outlet orifice is formed in a predetermined member. This step includes a step of making an orifice plate from resin by transfer molding or injection molding, a step of making an orifice plate by forming an opening in a plate-like member, and a step of making an orifice plate by forming an opening in a flexible print film. Here, a member for defining an orifice is called an orifice plate or a top plate.

A heater board with a circuit for driving a heat generating member obtained in this manner is combined with an orifice plate, and assembled to form an ink jet recording head in step S15.

In the subsequent step 16, an ink tank is mounted in the recording head, and ink is injected into the tank. The ink injection step includes a step of replenishing ink consumed as a result of use of the recording head.

The recording head completed in this way is mounted on a carriage of the main unit of the recording apparatus. Necessary power is supplied from the main unit via the carriage.

Needless to say, the use of color inks makes it possible to perform color printing.

[First Embodiment]

Figure 3:
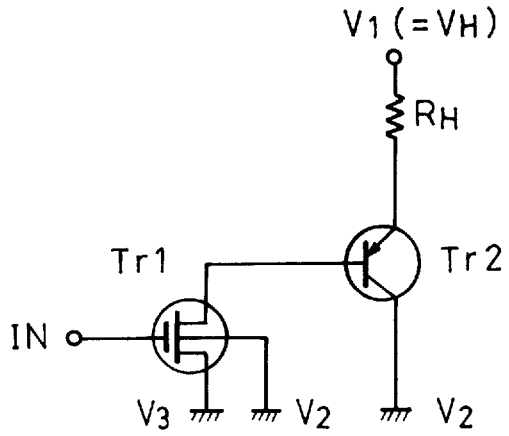
FIG. 3 is a circuit diagram of a recording head according to a first embodiment of the present invention.

FIG. 3 shows a drive circuit of a recording head in accordance with a first embodiment of the present invention.

Reference character Tr1 denotes an n-channel MOS transistor serving as an FET. Reference character Tr2 denotes a pnp transistor serving as a BJT. Reference character $R_H$ denotes a heater.

The reference voltage $V_H$ of the first voltage source V1 is set at a positive potential, and the reference voltages of the second and third voltage sources V2 and V3 are grounded. In order to stabilize the operation of the field-effect transistor Tr1, the channel potential (also called the well potential or the back gate potential) is maintained at the grounded potential.

Figure 4:
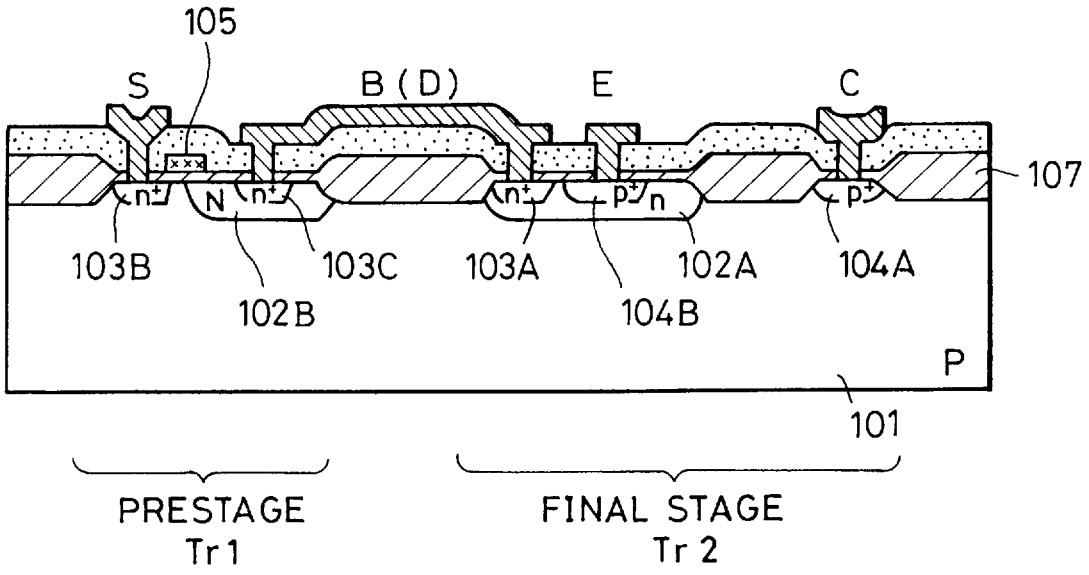
FIG. 4 is a sectional view of part of the recording head shown in FIG. 3.
Figure 5:
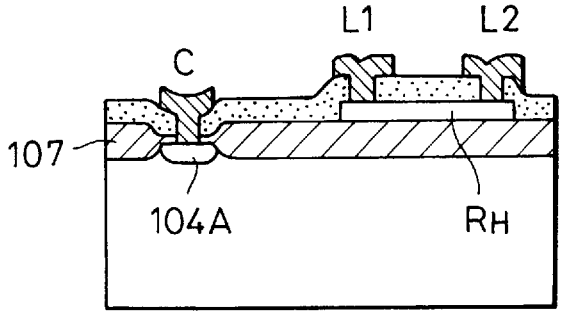
FIG. 5 is a sectional view of the heater portion of the recording head shown in FIG. 5.
Figure 6:
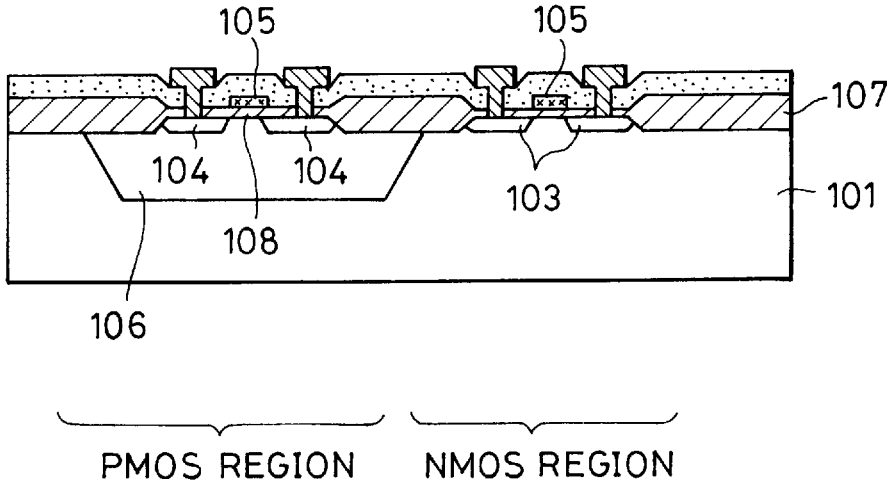
FIG. 6 is a sectional view of a logic circuit.

FIG. 3 is a circuit diagram of the recording head in accordance with this embodiment. FIGS. 4 to 6 are sectional views of each section. Referring to FIG. 4, reference numeral 101 denotes a semiconductor base made of silicon or the like. Reference numerals 102A and 102B denote the base of a bipolar transistor at the final stage and a low concentration drain diffusion layer of a MOS transistor at the prestage, respectively, and are formed at the same time. Reference numerals 103A, 103B and 103C denote a base contact region, the source, and a high concentration drain diffusion layer of a MOS transistor at the prestage, respectively, and are formed at the same time. Reference numerals 104A and 104B denote a collector contact, and an emitter, respectively, and are formed at the same time. Reference numeral 105 denotes a gate electrode of a MOS transistor. The base 101 serves as the common collector of the bipolar transistor and the well of the MOS transistor Tr1.

FIG. 5 shows the cross section of a portion where the heat generating member is disposed. The heat generating member $R_H$ is made of a thin film resistor, and has a terminal L1 connected to the emitter of the transistor Tr2 and a terminal L2 connected to the first voltage source.

FIG. 6 shows the cross section of a portion where the CMOS circuit for supplying signals to the gate of the field-effect transistor Tr1 is disposed.

The advantages of this embodiment will be described below in a comparison with the example shown in FIGS. 16 and 17 by providing numerical values.

Figure 16:
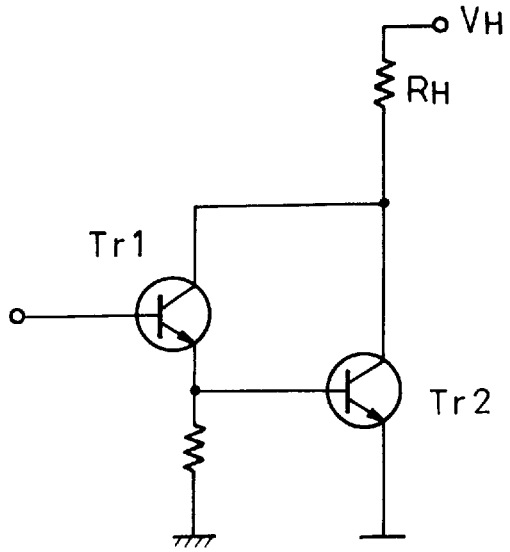
FIG. 16 shows the construction of a recording head in accordance with a comparative example.
Figure 17:
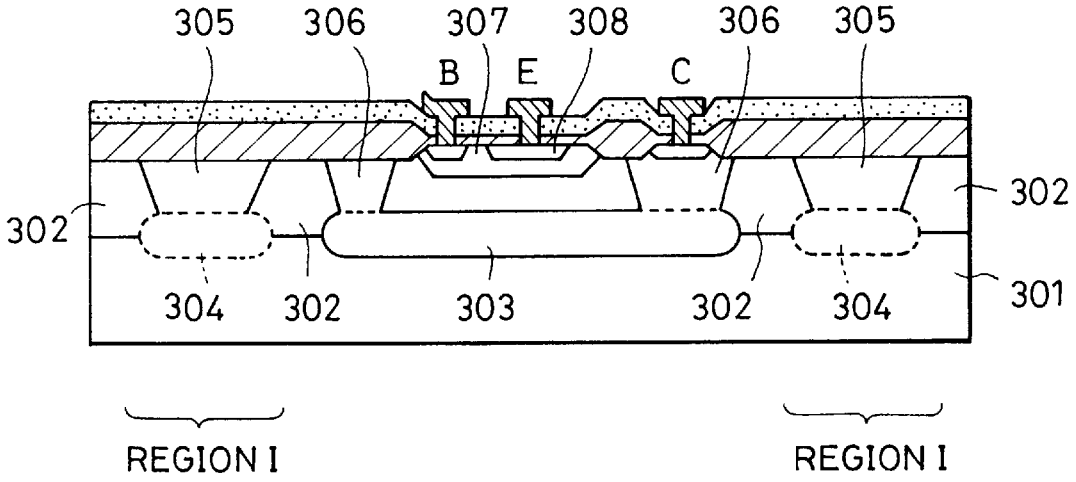
FIG. 17 shows the construction of a recording head in accordance with the comparative example.

The example shown in FIGS. 16 and 17 has the following specific two problems to be solved.

One problem is that since the drive unit is formed into a simple Darlington circuit, the heater which is a load is attached to the collector side, and when the heater is arranged on the array, it becomes necessary to electrically isolate the collectors of the transistors of the drive unit individually. Those portions indicated as region I in FIG. 17, i.e., the portions of the p-type buried layer 304 and the p-type diffusion layer 305, correspond to those isolation regions. In a case where the epitaxial layer 302 formed of the diffusion layer is formed to be approximately 10 $\mu$m, the above-mentioned isolation region, when lateral spreading is taken into consideration, corresponds to the dimension of 15 $\mu$m or more.

Here, when the pitches of the heater array are considered, the heater array is approximately 42 $\mu$m in the scale of 600 dpi (dots per inch), and if the isolation region which is originally an inactive region occupies 15 $\mu$m or more, it becomes difficult to form transistors in between. Therefore, a contrivance becomes necessary such that the transistors at the final stage are arranged on two different levels in the even numbers and the odd numbers of the heater array so as to circumvent constraints of dimensional limitations. Even in this embodiment, very small size chips cannot be obtained and, as a result, the cost increases.

Another major problem is that manufacturing steps become complex. Since the logic circuit in a stage anterior to the heater driver is usually formed of CMOS, the steps of manufacturing the chip conform to the CMOS manufacturing step. However, when a Darlington circuit of a simple npn bipolar transistor is used in the drive unit, the number of masking steps increases by four, and further, a step of growing an epitaxial layer becomes necessary. Here, the increased masking steps include the step of masking four of the n-type buried layer 303, the p-type buried layer 304, the deep n-type diffusion layer 306, and the p-type diffusion layer 307 which forms the base. The complexity of these steps inevitably causes manufacturing costs to increase, and more particularly, the presence of the epitaxial layer is a fatal hindrance factor with respect to the possibility of a reduction in cost.

According to this embodiment, the isolation regions of the transistors of the drive unit, which is the above-described problem, are eliminated in part or reduced in part, and it is possible to arrange the transistors in one row in the same way as for the heater array.

Also, according to this embodiment, it is possible to obviate the necessity of the epitaxial layer, and further to eliminate the masking step and to achieve the same performance as that of the comparative example at a low cost.

For comparison with the above-described comparative example, the recording head of this embodiment is manufactured in the manner described below.

(1) The voltage $V_H$ supplied to the heater resistor is set at 22 V, the heater resistance $R_H$ is set at 110 Ω, and a heater current of 200 mA flows during ON time. Therefore, the breakdown voltages of the transistor Tr1 at the prestage and that at the final stage in FIGS. 3 and 4 are set at 35 V or more.

(2) The output from the logic circuit is set at 0 to +5 V, and the drive unit must switch in accordance with an input signal in the above range.

(3) The logic circuit must be made of CMOS, and formed in the same substrate as the drive unit.

In addition to the above-described conditions, when the power supply of the logic circuit is set at 0 to +5 V, the grounded region becomes a p-type material, and it is necessary for the base 101 to use a p-type material. If a silicon p-type substrate is to be used, the final stage is automatically set to be a pnp bipolar transistor.

If the power supply for supplying a voltage to the logic circuit and the heater is at a negative potential, the grounded region is an n-type material, and the polarity of the transistor at the final stage is reversed and becomes an npn transistor region.

Since the polarity of the base 101 is determined to be p-type, the resistivity of the base 101 is determined next. There are no particularly major limitations on the logic circuit side, but the following two requirements, with respect to the resistivity of the base, are imposed on the transistor at the final stage.

(1) In order to achieve a power-supply rating of 35 V or more, a reverse breakdown voltage of 35 V or more is required for the diode formed between the base 101 and the base region 102, and, for this purpose, the concentration of impurities of the substrate must be $2\times10^{16}/cm^3$.

(2) When the collector resistance is considered, since the buried layer is not present, it is necessary to use a substrate having as high a concentration of impurities as possible in order to decrease parasitic resistance.

First, from the requirement (1), considering the margin, a substrate having an impurity concentration of $1\times10^{16}/cm^3$ and a resistivity of 1 to 2 Ω.cm is selected. The collector resistance at this time becomes approximately 7.5 Ω when the dimensions of the bipolar transistor are 640 μm×64 μm, and $V_{CE}$ is consumed during on time by an amount of 1.5 V. This level tentatively falls within the tolerable range. When in the following equation:

$$R=\rho\cdot(l/S) \quad (1)$$

where R is the resistance, ρ is the resistivity, l is the resistor length, and S is the resistor cross section, the value of resistance cross section S is calculated on the basis of the thickness of the base 101, and R has a value of 0.8 Ω or less. When the thickness t of the base is larger than the resistor length l, equation (1) does not hold, and reaches the above-described value. In addition, an advantage of the common collector is that collector electrodes on both sides of the device operate, and the hole current flows in two directions.

The value of the impurity concentration of $1\times10^{16}/cm^3$ of this substrate corresponds to the p well concentration of NMOS (N-channel MOS) which constitutes the logic circuit, and the substrate itself serves the function of the p well. Therefore, it is advantageous in that NMOS can be formed on the same base 101 without a p well. Also, for the same reason, the substrate can be substituted for the well of the MOS transistor (Tr1 of FIG. 3) in a stage anterior to the driver.

Since the base 101 is determined, manufacturing steps will be described below in accordance with the CMOS manufacturing steps, which are conventional technology.

Initially, as shown in FIG. 6, an n-type well 106 of the PMOS (P-channel MOS) section on the logic circuit side is formed on the base 101 which is made ready.

Next, a field oxide film 107 is formed to a thickness of 1 μm at a predetermined place by a selective oxidation process.

Regarding a channel stop, an n-type channel stop of the logic circuit region is formed of an active region with self-alignment. In the driver part, an n-type channel stop is formed with both Tr1 and Tr2 being offset by 5 μm. Then, a gate oxide film having a thickness of 500 Å is made to grow, channel doping is performed thereon, and the gate electrode 105 is formed from doped polycrystal silicon. Up to this point, the operation is the same as the CMOS manufacturing step which is a conventional technology.

Next, the base 102A of the transistor Tr2 of the driver unit and the low concentration region 102B of the drain portion of the transistor Tr1 are formed at the same time. $4\times10^{13}$ ions/$cm^3$ of phosphorus is implanted by an ion implantation method, and drive-in is performed for two hours at 1,150° C. In this ion implantation method, phosphorus is implanted by self-alignment on the drain edge side of Tr1 with the polycrystal silicon side 105 as the mask.

The reason why a low concentration diffusion layer is required on the drain side will now be explained. As shown in FIG. 3, $V_{DS}$ of Tr1 when the drive unit is off is as follows:

$$V_{DS}\cong V_H \quad (2)$$

and since $V_G\cong V_G=0$ V (during off time), $V_{GD}\cong V_H$. As a result, when the drain is formed of only a high concentration layer, the voltage of $V_H$ is directly applied in the drain edge portion of the gate oxide film. When $V_H$=22 V, this is lower than the breakdown voltage of 40 V (equivalent to 8 MV/cm) of the silicon oxide film, 500 Å thick, but the reliability of the operation of the MOS transistor is considerably deteriorated. Therefore, in this embodiment, a depletion layer is formed by forming the low concentration layer 102B on the drain side so that the voltage $V_H$ supplied to the heater is not directly applied to the gate oxide film. The diffusion of the low concentration layers 102A and 102B to the field oxide film 107 side is for the purpose of securing dielectric strength between the drain 102B and the base 101. Since, as described above, a voltage of $V_H$ is applied to the drain region during current off operation, it is necessary to secure dielectric strength.

Since the above-described process can be performed in the same process as the process of forming the base of the bipolar transistor, the process does not become particularly complex.

Next, the NMOS source and drain part 103 of the logic circuit of FIG. 6, the source and the high concentration diffusion layer 103B and 103C of Tr1 at the prestage, and the base contact region 103A of Tr2 at the final stage in FIG. 4 are formed at the same time. To be specific, $7\times10^{15}/cm^3$ of phosphorus is implanted by an ion implantation method.

Next, the PMOS source and drain part 104 of the logic circuit (FIG. 6), the emitter, and the collector contact layers 104B and 104A (FIG. 4) at the final stage are formed at the same time. To be specific, 2 to $3\times10^{15}/cm^3$ of boron difluoride is implanted. Since this step is a step of forming the emitter of the bipolar transistor, ion implantation at a concentration higher than that of forming the PMOS source and drain in the normal CMOS manufacturing step is preferable.

Thereafter, the wiring region and the interlayer are formed in accordance with the conventional CMOS manufacturing step.

Figure 7:
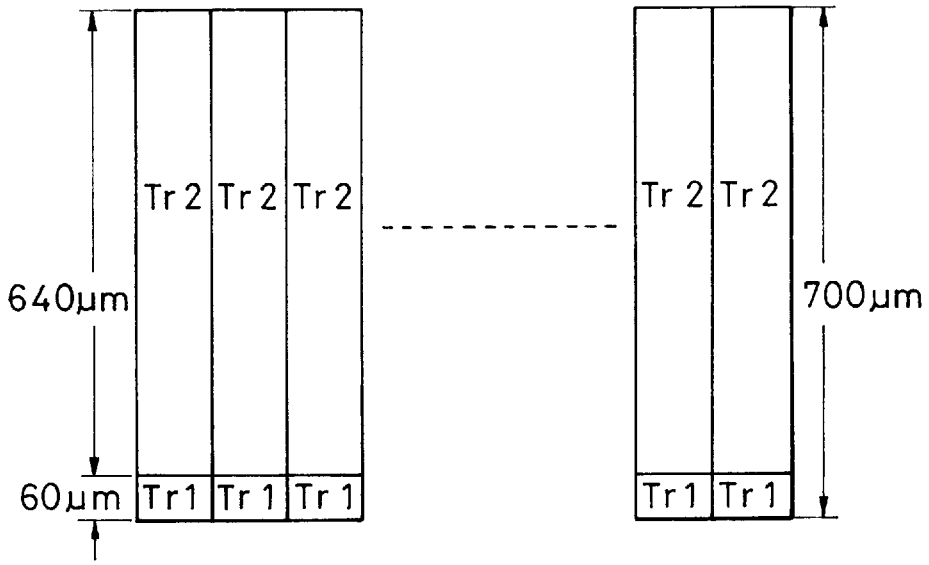
FIG. 7 is a schematic plan view illustrating an example of a transistor arrangement.

When the transistor Tr1 at the prestage and the transistor Tr2 at the final stage are not arranged laterally, but arranged longitudinally, and the above-described manufacturing step is used, the drive unit falls within 700 μm, as shown in FIG. 7.

In summary, in this embodiment, the following two constructions are used.

(1) The final stage of the drive unit is formed of a pnp or npn bipolar transistor. The heater, which is a load, is connected to the emitter side, and the collectors of each transistor are connected commonly to the base itself and grounded.

(2) The prestage of the drive unit is formed from the prestage of a MOS type element whose polarities are reversed to those of the final stage, i.e., an n-type MOS transistor with respect to the final stage of a pnp bipolar transistor and a p-type MOS transistor with respect to the final stage of a npn bipolar transistor, and the source of the prestage is grounded.

With the above-described construction, it is possible to reduce the area of the heater drive unit to approximately 60% of conventional units, and to decrease the manufacturing cost in the conversion of the silicon wafer by approximately 35%.

Figure 8:
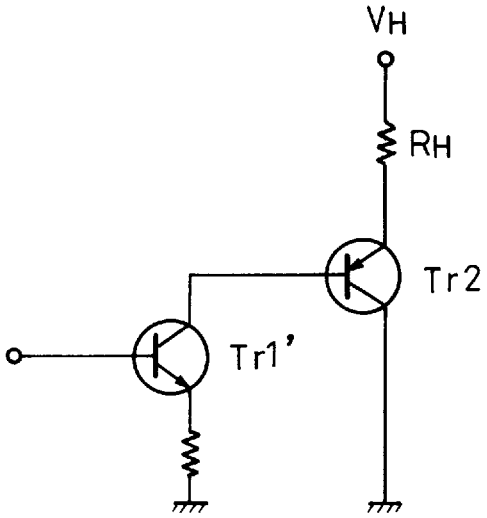
FIG. 8 is a circuit diagram illustrating the construction of a reference example.

As a reference example, a circuit is shown in FIG. 8. Although the transistor Tr2 of the final stage is the same as that of the above-described embodiment, a bipolar transistor whose polarities are reversed is used as a transistor Tr1' at the prestage. In this case, the collector of Tr1' can be formed at the same time as the n-type well of the logic circuit PMOS, but it is necessary to make the base in a separate step. Since the collector and base breakdown voltage of Tr1' is made to be larger than VH, there is a limitation on the impurity concentration of the collector of Tr1', and further the impurity concentration of the substrate becomes smaller than that of the collector of Tr1'. Since this is the fate of planarization technology, this causes the collector resistance of Tr2 to increase more than in the above-described embodiment.

[Second Embodiment]

A conjunction type FET may be used in the part of Tr1'. In this case, when the transistor is normally on, the output of the logic circuit needs to be turned to the negative potential. Therefore, the embodiment which is considered best at the present time is that a field-effect transistor is disposed in a stage anterior to the drive circuit.

[Third Embodiment]

As regards manufacturing steps, there is another method which does not increase the manufacturing cost. In FIG. 4, the low impurity concentration drain diffusion layer 102B of the field-effect transistor at the prestage is used in common with the base 102A of the bipolar transistor at the final stage. However, there is a method in which the low impurity concentration drain diffusion layer 102B is used in common with the n-type well 106 of CMOS rather than used in common with the low impurity concentration drain diffusion layer 102B. Use of this method has an advantage in that the drain 102B can be set at an impurity concentration lower than that of the base 102A at the same number of steps. This method, however, has a potential problem in that it is difficult to form the layer 102B in a self-aligned manner, and therefore the alignment is difficult.

Figure 9:
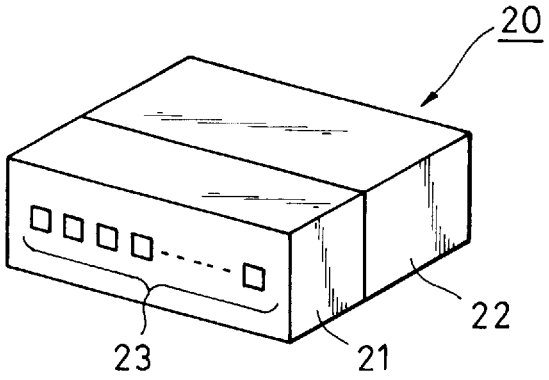
FIG. 9 is a schematic sectional view illustrating a head assembly using an ink jet recording head in accordance with the present invention.

FIG. 9 is a schematic sectional view illustrating a head assembly using an ink jet recording head in accordance with the present invention, and an ink tank.

This assembly 20 comprises a head 21 having a number of ink outlet orifices 23, and an ink tank 22 for housing ink. The ink tank has housed therein an ink absorbing member (not shown), such as a porous member, for holding ink. The head 21 and the ink tank 22 may be formed integral with each other or removable from each other.

Figure 10:
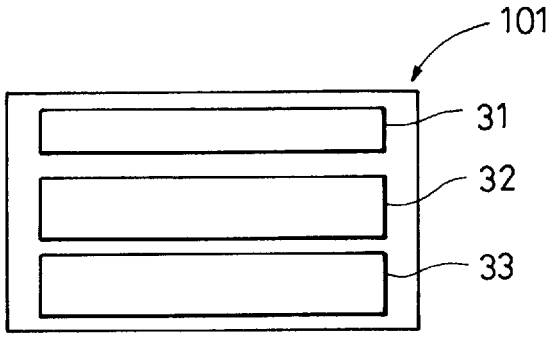
FIG. 10 is a top plan view of a base of an ink jet recording head in accordance with the present invention.

FIG. 10 is a top plan view of a base of an ink jet recording head in accordance with the present invention. A heater assembly for heating ink, shown in FIG. 5, is disposed in a portion designated by reference numeral 31, a drive unit shown in FIGS. 4 and 7 is disposed in a portion designated by reference numeral 32, and a CMOS logic circuit shown in FIG. 6 is disposed in a portion designated by reference numeral 33. Here, the illustration of the wiring is omitted.

Figure 11:
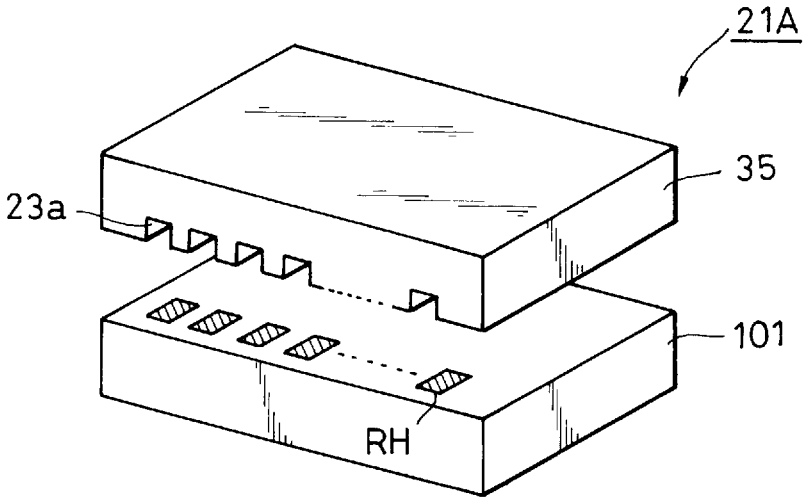
FIG. 11 shows a method of assembling an ink jet recording head in accordance with the present invention.

FIG. 11 shows a method of assembling the ink jet recording head.

Reference numeral 21A denotes a head of a type which ejects ink substantially parallel to the heat generating surface of the heater, which head is formed by laminating a top plate 35 with grooves 23*a* onto the base 101. One heater $R_H$ corresponds to one groove 23*a,* and the heater RH is formed with one ink fluid path (nozzle).

Figure 12:
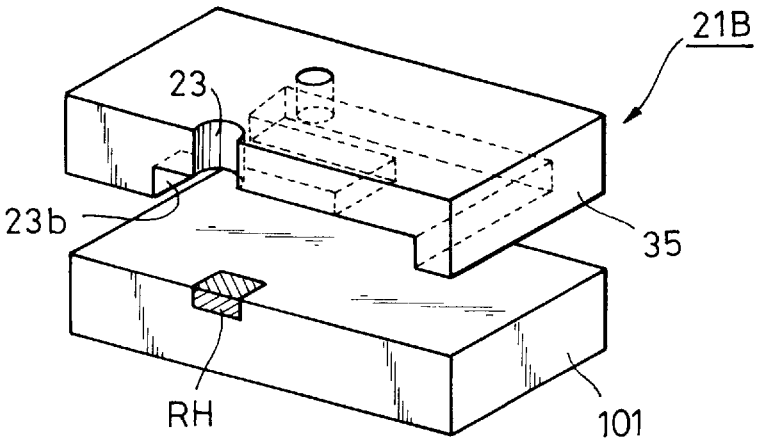
FIG. 12 shows a method of assembling an ink jet recording head in accordance with the present invention.

FIG. 12 shows a method of assembling another head, and shows the cross section so as to make it easy to understand the relation between the ink outlet orifice 23 and the heater.

Reference numeral 21B denotes a head of a type which ejects ink in a direction intersecting the heat generating surface of the heater, which head is formed by laminating a top plate 35 having grooves 23*b* and the ink outlet orifices 23 onto the base 101. One heater $R_H$ corresponds to one ink outlet orifice, and the heater $R_H$ is formed with one ink fluid path (nozzle).

The ink tank and the ink fluid path communicate with each other via an ink flow path in a portion which is not shown, and ink is supplied to the ink fluid path.

Figure 13:
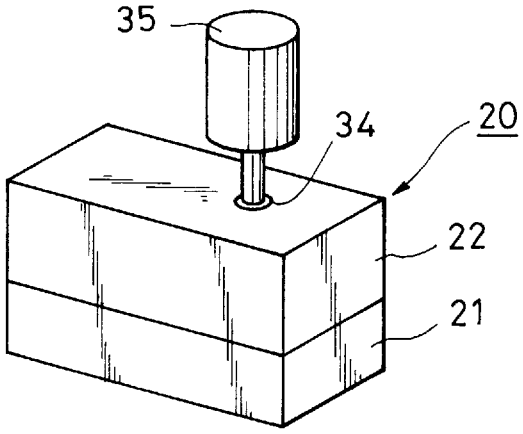
FIG. 13 shows a situation in which ink is injected into an ink jet recording head in accordance with the present invention.

FIG. 13 is a schematic illustration showing a step of injecting ink from among the steps of manufacturing the ink jet recording head in accordance with the present invention.

Reference numeral 35 denotes an ink injector for housing ink therein. Ink is injected by the user into the ink absorbing member inside the ink tank 22 through the ink injection opening or an air communication opening 34 provided in the ink tank 22, and the ink is absorbed in the ink absorbing member.

This step is the same as the step of replenishing ink when the level of ink inside the ink tank 22 becomes low.

Figure 14A:
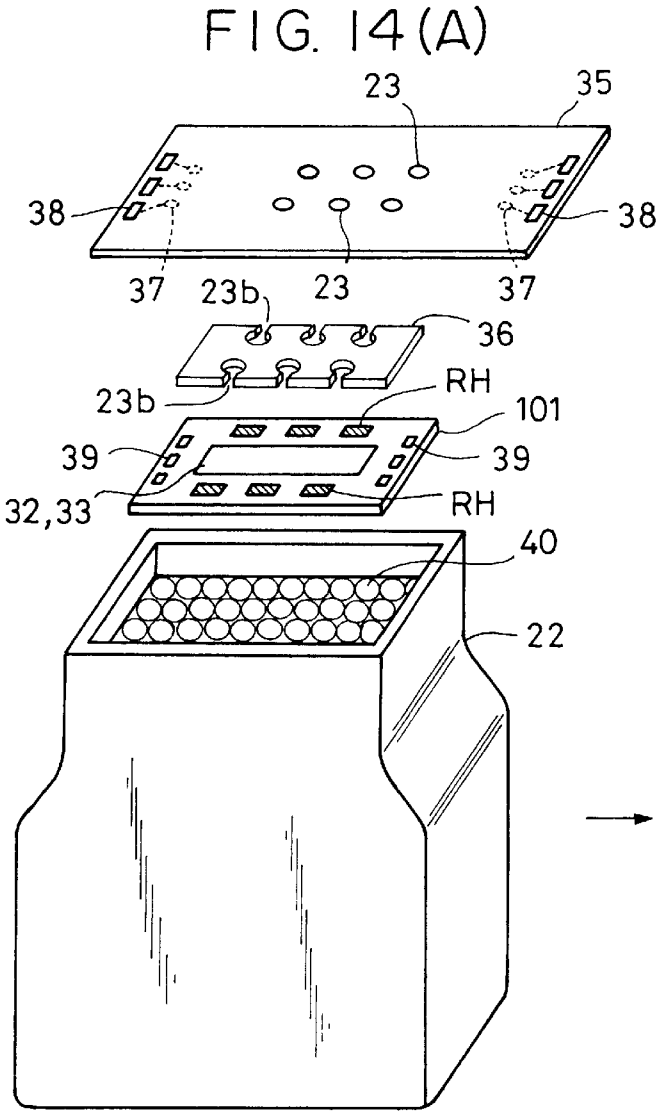
FIGS. 14(A) and 14(B) show another recording head of the present invention.
Figure 14B:
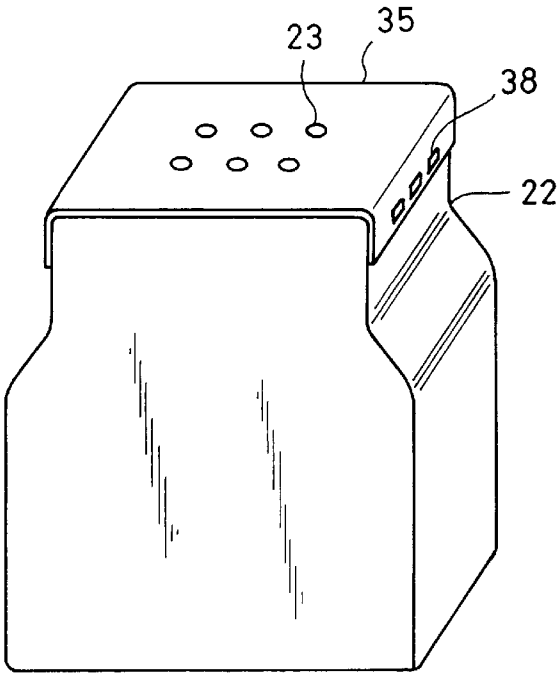

FIGS. 14(A) and 14(B) show an example in which a part of the construction of the head assembly shown in FIG. 12 is changed.

An ink absorbing member 40 is disposed inside the ink tank 22. In the base 101, two rows of three heaters $R_H$ are arranged on both ends of the base 101. Disposed between the heater rows are a drive circuit 32, including a BJT and an FET, and a CMOS logic circuit 33. Reference numeral 39 denotes a terminal of the base 101. Reference numeral 36 denotes a barrier member made of a photosensitive resin or the like, which barrier member defines the ink flow path 23*b*. Reference numeral 35 denotes a flexible printed circuit film having an ink outlet orifice 23. Reference numeral 37 denotes a terminal, disposed on the bottom of the film 35, which connects to the terminal 39. Reference numeral 38 denotes an external connection terminal disposed on the top of the film 35, which terminal connects to the terminal 37 through printed wiring.

The film 35, the barrier member 36, and the base 101 are registered so that the ink outlet orifices 23, the ink flow path 23*b,* and the heater $R_H$ come into alignment with each other and are joined together by an adhesive or the like. At this time, the terminals 37 and 39 are brought into electrical contact with each other.

When this head assembly is mounted in the main unit of the recording apparatus, signals are transmitted to the terminal 38, the terminal 37, and the terminal 39 in this order, and the drive circuit 32 and the CMOS logic circuit 33 drive the heater $R_H$.

Ink is supplied from the ink absorbing member 40 via the terminal portion of the substrate into the ink flow path 23*b*. The heater $R_H$ heats the ink inside the ink flow path 23*b* to a temperature exceeding that which causes nucleate boiling, causing a nucleate boiling phenomenon to occur. The generated gas bubbles cause ink to be ejected from the ink outlet orifice, causing ink droplets to be generated. These ink droplets adhere onto the recording medium, and characters and images are formed thereon.

Figure 15:
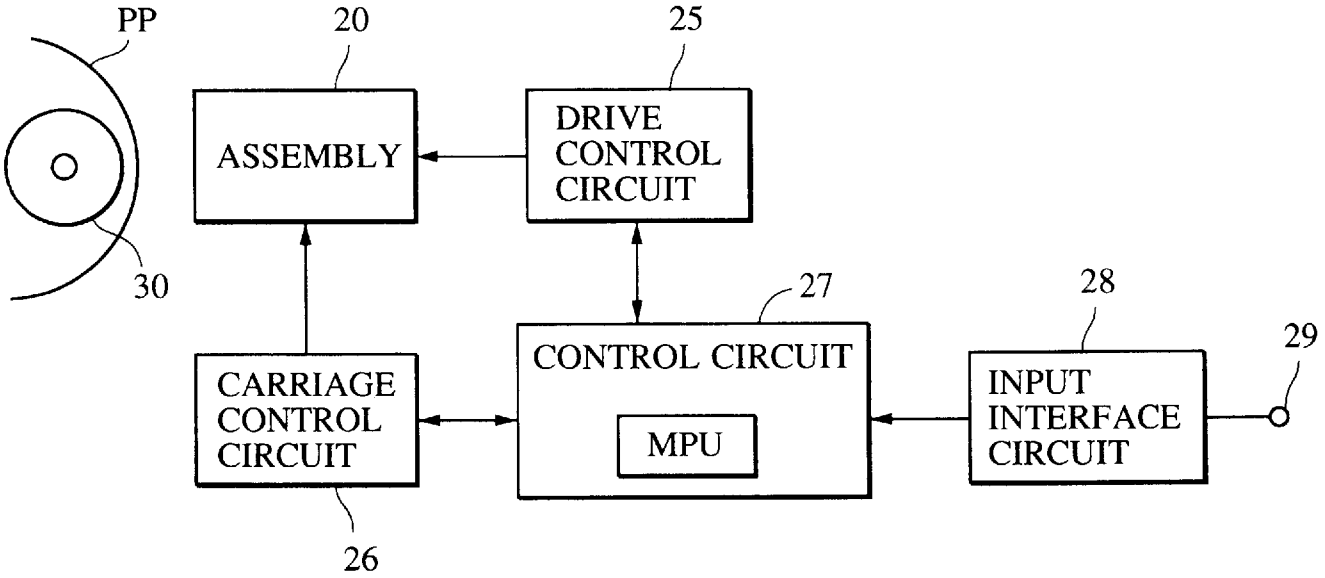
FIG. 15 shows a control system of a recording apparatus according to the present invention.

FIG. 15 is a block diagram of the control system of a recording apparatus having the assembly 20 mounted on the carriage.

A control signal for recording an image, together with image data, is sent out from a drive control circuit 25 via the carriage to the head assembly 20. The head assembly 20 is reciprocated along the one main scanning direction of the recording medium PP by means of a carriage drive circuit 26. Reference numeral 30 denotes a roller serving as transport means for transporting the recording medium PP along the subscanning direction.

Reference numeral 27 denotes a control circuit which controls the entire apparatus and has a microprocessor unit (MPU). Reference numeral 28 denotes an input interface circuit which interfaces between the image data input terminal 29 and the control circuit 27.

As has been described up to this point, according to the present invention, the isolation region of each transistor is substantially eliminated in the heater drive unit of the ink jet recording head, and the transistors can be fitted into an area of, for example, 60% or less of the conventional example.

According to the present invention, a drive unit can be formed in the same substrate by adding a masking step to the normal CMOS manufacturing step, at least four masking steps are eliminated compared with the conventional example, and an expensive epitaxial layer forming step is not necessary. As a result, it becomes possible to reduce costs by 35% in terms of the wafer manufacturing cost.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An inkjet recording head, comprising:

a heat generating member having at least two terminals; and a drive circuit for supplying an electric current to said heat generating member, wherein said drive circuit comprises;

a bipolar transistor having a plurality of main electrode regions and a control electrode region, one of the main electrode regions being connected to one of the terminals of said heat generating member, and a field-effect transistor having a plurality of main electrode regions and having one of the main electrode regions connected to the control electrode region of said bipolar transistor, and wherein a first voltage source is connected to the other terminal of said heat generating member, a second voltage source is connected to the other main electrode region of said bipolar transistor and the other main electrode region of said field-effect transistor, wherein said bipolar transistor is a pnp transistor, said field-effect transistor is an N-channel insulation gate type transistor, and said transistors are integrated in a p-type semiconductor substrate, wherein said bipolar transistor and said field-effect transistor are formed in each of two active regions surrounded by an insulating film region, wherein said one of the main electrode regions of said field-effect transistors includes a first region having an impurity concentration and a second region having an impurity concentration which is lower than that of said first region.

2. A method of manufacturing an ink jet recording head, comprising the steps of:

providing an ink jet recording head comprising:

a heater array comprising a plurality of heaters for heating an ink in order to generate gas bubbles and thereby eject the ink, a plurality of drive units for driving respective said heaters, each of said drive units comprising a field-effect transistor having a drain, at a prestage and a bipolar transistor having an emitter at a final stage, a collector and a base, at a final stage, and a logic circuit part in a same substrate as said heaters and said drive units, wherein each of said heaters is connected to the emitter of an associated said bipolar transistor, the respective collectors of said plurality of bipolar transistors are commonly connected and grounded, and the respective bases of said plurality of bipolar transistors are connected to the respective drains of said field-effect transistors, said logic circuit part comprising a complimentary field-effect transistor; and forming in a same step a low concentration diffusion layer from among two types of diffusion layers of said field-effect transistor at the prestage and a base region diffusion layer of the bipolar transistor at the final stage.

3. A method according to claim 2, further comprising the steps of forming in a same step a part of a diffusion layer of the drain of the field-effect transistor of said drive unit, and a well of the field-effect transistor which is of a channel type opposite to that of the field-effect transistor of the drive unit from among the complimentary field-effect transistors of said logic circuit.

4. A method according to claim 3, wherein said bipolar transistor and said field-effect transistor are formed within a semiconductor region of a conducting type which is the same as that of the main electrode region of said bipolar transistor.

5. A method according to claim 3, wherein the main electrode region of said field-effect transistor is formed in a well of a same conducting type as that of the main electrode region of said bipolar transistor.

6. A method according to claim 3, wherein said bipolar transistor and said field-effect transistor are formed in each of two active regions surrounded by a field insulating film.

7. A method according to claim 3, wherein said recording head further comprises a CMOS circuit for supplying signals to a control electrode region of said field-effect transistor.

8. A method according to claim 3, wherein said recording head further comprises: a CMOS circuit for supplying signals to a control electrode region of said field-effect transistor, wherein one of the transistors which constitute said CMOS circuit includes a transistor having a main electrode region of a first conducting type formed in a well of an opposite conducting type formed in a first conducting type semiconductor substrate, and a transistor having a main electrode region of an opposite conducting type formed in said semiconductor substrate.

9. A method according to claim 3, wherein said heat generating member comprises a thin film resistor disposed on a substrate on which are provided said bipolar transistor and said field-effect transistor.

10. A method according to claim 3, wherein said heat generating member comprises a thin film resistor disposed on a semiconductor region having said bipolar transistor and said field-effect transistor.

11. A method according to claim 3, wherein said recording head further comprises a plurality of said bipolar transistors and a plurality of said field-effect transistors, wherein the other main electrode regions of said plurality of bipolar transistors are commonly connected to each other, and the other main electrode regions of said plurality of field-effect transistors are commonly connected to each other.

12. A method according to claim 3, wherein said one of the main electrode regions of said field-effect transistors includes a first region having an impurity concentration and a second region having an impurity concentration which is lower than that of said first region.

13. A method according to claim 3, wherein said one of the main electrode regions of said bipolar transistors comprises a first region having an impurity concentration and a second region having an impurity concentration which is lower than that of said first region.

14. A method according to claim 3, wherein said one main electrode region of said field-effect transistor and the control electrode region of said bipolar transistor each comprises a first region having an impurity concentration and a second region having an impurity concentration which is lower than that of said first region.

15. A method according to claim 3, wherein an area occupied by said field-effect transistor is smaller than an area occupied by said bipolar transistor.

16. A method according to claim 3, wherein an area occupied by said bipolar transistor is at least twice as large as an area occupied by said field-effect transistor.

17. A method according to claim 3, wherein said field-effect transistors are provided along a length of said bipolar transistors with the bipolar transistors being formed to be longer along their length.

18. A method according to claim 3, wherein said field-effect transistors and said heat generating member are provided along a length of said bipolar transistors with the bipolar transistors being formed to be longer along their length.

19. A method according to claim 3, wherein the voltages of said first, said second and said third voltage sources are supplied from a main unit of a recording apparatus.

20. A method according to claim 3, wherein said bipolar transistor is a pnp transistor, and said field-effect transistor is an N-channel insulation gate type transistor.

21. A method according to claim 3, wherein said bipolar transistor is a pnp transistor, said field-effect transistor is an N-channel insulation gate type transistor, and said second and said third voltage sources are a common voltage source.

22. A method according to claim 3, wherein said recording head further comprises an ink outlet orifice for ejecting an ink in a direction parallel to a heat generating surface of said heat generating member.

23. A method according to claim 3, wherein said recording head further comprises an ink outlet orifice for ejecting an ink in a direction intersecting a heat generating surface of said heat generating member.

24. A method according to claim 3, further comprising the step of providing an ink tank for housing an ink.

25. A method according to claim 3, further comprising the step of providing a removable ink tank for housing an ink.

26. A method according to claim 3, wherein said recording head further comprises a film formed with an ink outlet orifice for ejecting an ink.

27. A method according to claim 3, wherein said recording head further comprises:

a film formed with an ink outlet orifice for ejecting an ink; and a wiring part.

28. A method according to claim 3, further comprising the step of providing a reciprocable carriage on which said recording head is mounted.

29. A method according to claim 3 wherein said recording apparatus effects color printing by supplying a plurality of color inks to said recording head.

30. A method according to claim 3, wherein the voltages of said first, said second and said third voltage sources are supplied from a main unit of the recording apparatus.

31. A method according to claim 3, further comprising the steps of:

providing an ink tank, and injecting an ink into the ink tank.

32. A method according to claim 3, wherein a diffusion layer of the drain of each said field-effect transistor at the prestage comprises two types of diffusion layers having different concentrations from one another.

33. A method according to claim 3, wherein said logic circuit part comprises a complimentary field-effect transistor.

* * * * *

UNITED STATES PATENT AND TRADEMARK OFFICE

CERTIFICATE OF CORRECTION

PATENT NO. : 5,850,242

DATED : December 15, 1998

INVENTOR(S) : TETSUO ASABA

It is certified that error appears in the above-identified patent and that said Letters Patent is hereby corrected as shown below:

Title page, item

[56] REFERENCES CITED

Foreign Patent Documents
"404041258" should read --4-041258--.

COLUMN 1

Line 51, "members Rh" should read --members RH--.

COLUMN 5

Line 19, "step 16," should read --step S16,--.

COLUMN 9

Line 21, "VH," should read --$V_H$,--.

COLUMN 10

Line 7, "heater RH" should read --heater $R_H$,--.

UNITED STATES PATENT AND TRADEMARK OFFICE

CERTIFICATE OF CORRECTION

PATENT NO. : 5,850,242

DATED : December 15, 1998

INVENTOR(S) : TETSUO ASABA

It is certified that error appears in the above-identified patent and that said Letters Patent is hereby corrected as shown below:

COLUMN 12

Line 24, "complimentary" should read --complementary--.
Line 37, "complimentary" should read --complementary--.
Lines 64-65, "heat generating member" should read --heater--.

COLUMN 13

Lines 1-2, "heat generating member" should read --heater--.
Line 38, "heat generating member" should read --heater--.

COLUMN 14

Line 8, "heat generating member" should read --heater--.
Line 12, "heat generating member" should read --heater--.
Line 29, "said" should read --a--.

UNITED STATES PATENT AND TRADEMARK OFFICE

CERTIFICATE OF CORRECTION

PATENT NO. : 5,850,242

DATED : December 15, 1998

INVENTOR(S) : TETSUO ASABA

It is certified that error appears in the above-identified patent and that said Letters Patent is hereby corrected as shown below:

COLUMN 14 CONTINUED

Line 34, "the" should read --a--.
Line 41, "transistor" should read --transistors--.
Line 45, "complimentary" should read --complementary--.

Signed and Sealed this

Thirtieth Day of November, 1999

*Attest:*

*Attesting Officer*

Q. TODD DICKINSON

*Acting Commissioner of Patents and Trademarks*